United States Patent [19]

Takahashi et al.

[11] Patent Number: 4,462,844

[45] Date of Patent: Jul. 31, 1984

[54] PROCESS FOR MANUFACTURING HOT EXTRUDED ALLOY PRODUCTS

[75] Inventors: Tsunetoshi Takahashi; Masao Suzuki; Tadayuki Okinaka, all of Hikarishi, Japan

[73] Assignee: Nippon Steel Corporation, Tokyo, Japan

[21] Appl. No.: 401,978

[22] Filed: Jul. 26, 1982

[30] Foreign Application Priority Data

Jul. 24, 1981 [JP] Japan ..... 56-115227

[51] Int. Cl.[3] ..... C21D 7/04; C21D 7/06

[52] U.S. Cl. ..... 148/12 E; 148/11.5 R; 148/11.5 N; 148/12 EA

[58] Field of Search ..... 148/12 E, 12 EA, 11.5 R, 148/11.5 N

[56] References Cited

U.S. PATENT DOCUMENTS

| | | | |
|---|---|---|---|
| 4,070,209 | 1/1978 | Usui | 148/12 E |
| 4,168,190 | 9/1979 | Eguchi et al. | 148/12 E |
| 4,204,884 | 5/1980 | Berg et al. | 148/12 E |

*Primary Examiner*—W. Stallard

*Attorney, Agent, or Firm*—Wenderoth, Lind & Ponack

[57] ABSTRACT

A process for manufacturing a hot extruded product from a continuously cast stainless steel or super alloy billet comprises cold working the surface of the billet, heating the billet to extrude it and at the same time to provide a fine recrystallized structure in its surface layer, and hot extruding the billet.

8 Claims, 10 Drawing Figures

PROCESS FOR MANUFACTURING HOT EXTRUDED ALLOY PRODUCTS

BACKGROUND OF THE INVENTION

1. Field of the Invention

This invention relates to the hot extrusion of continuously cast stainless steels and super alloys into tubes, bars or sections.

2. Description of the Prior Art

There are a variety of metal working processes, and they are generally classified into hot and cold working processes. Hot working is widely employed as it enables the working of metals with a smaller force, and includes rolling, extrusion and forging. Hot extrusion is particularly advantageous, since it provides a high working ratio, and facilitates the manufacture of products having various shapes by merely changing the dies.

Hot rolled billets have long been used for hot extrusion. These billets are prepared by the hot rolling of ingots cast from molten metal, and have a circular cross section. With the development of continuous casting, however, it is now possible to prepare continuously cast billets having a circular cross section directly from molten metal without the intermediary of ingot making and cogging or blooming.

Continuous casting is, of course, applicable to stainless steels and super alloys. The use of continuously cast billets for hot extrusion is expected to provide a greatly improved yield in the manufacture of hot extruded stainless steel and super alloy products. It has, however, been impossible to employ continuously cast stainless steel or super alloy billets for hot extrusion, since a lot of streaks, which extend in the extruding direction, appear on the surface of the extruded products, and impair their commercial value seriously. These surface defects are due to the fact that those materials do not undergo any phase transformation when they are heated to an extrusion temperature, and cooled. The products extruded from hot rolled billets develop hardly any such streaks.

The hot extrusion of continuously cast stainless steels having an as-cast structure has long been the subject of great interest. Extrusions from cast billets have a surface characterized by streaks or "score marks" resulting from coarse crystal grains in as-cast billets, as R. Cox points out in his article entitled "Part II: Recent Experiences with the 1150 Ton Extrusion Press at the Works of Low Moor Fine Steels Ltd.", Journal of The Iron and Steel Institute, March 1964, pages 246 to 260. Cox attempted upsetting in an extrusion container, but could not obtain any modification or recrystallization of the as-cast structure. He also conducted comparative tests using flat-faced and conical-entry dies, but could not achieve any improvement in the surface quality of extrusions.

In "Iron and Steel" (a Japanese journal), vol. 65 (1979), page 244, Sugitani et al. report that they could obtain steel tubes having a smooth surface by dividing crystal grains finely by expanding or like procedure. It is, however, considered in view of the experiments of Cox that the fine division of crystal grains by Sugitani et al. could be achieved by reheating after expansion.

SUMMARY OF THE INVENTION

It is an object of this invention to provide a process which can produce from continuously cast stainless steel or super alloy billets hot extruded products having a surface which is equal to, or better than that of extrusions from hot rolled billets.

Continuously cast billets have a highly directional as-cast structure, while hot rolling or cogging breaks down the structure, and provides a fine, randomly directional crystal structure. This invention is based on the results of extensive research conducted by the inventors to finely divide the crystal structure of continuously cast billets before hot extrusion.

According to this invention, there is provided a process for the manufacture of hot extruded alloy products which comprises cold working the surface of a continuously cast alloy billet, heating the cold worked billet to extrude it and at the same time to give its surface layer a finely divided structure, and hot extruding the billet.

DETAILED DESCRIPTION OF THE INVENTION

It is usual practice to prepare raw material for hot extrusion by cutting a long bloom into lengths of 400 to 1,000 mm, and machining the rear end of the lengths, which are then heated and extruded.

The process of this invention, however, employs a continuously cast billet. The surface of the billet is cold worked. The billet is heated to an extrusion temperature, and the cast structure of its surface layer is converted to a fine structure by recrystallization. It is advantageous for the billet to have a finely structured surface layer having a thickness of at least 3 mm.

Cold working is intended to enable recrystallization to take place only in the surface layer of the billet when it is heated. It is, therefore, sufficient to employ a relatively mild degree of cold working. For example, it is sufficient to roll an elongated continuously cast billet with a mild force providing a reduction rate of 1% or less after peeling it. Peeling and cold working can be accomplished simultaneously if the force of the holding rolls in a centerless peeling machine is utilized for the cold rolling of the billet. It is alternatively possible to employ shot, sand or grit blasting, liquid honing, or similar blasting technique. Blasting or honing can be performed either after the billet has been peeled, or before peeling to accomplish the removal of scale from the billet surface and its cold working simultaneously.

It is advisable that cold working should be effected on the front end surface of the billet which forms a part of the surface of an extruded product, since streaks are likely to appear on the front end of the product unless the structure in that area is finely divided before hot extrusion. No cold working is required on the rear end of the billet, since it is usually in intimate contact with a dummy block and does not form a part of the surface of the extruded product. Blasting or honing is suitable for the cold working of the billet end surface.

Figure 1:
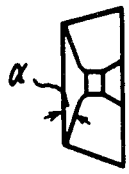
FIG. 1 is a view showing a die used in a conventional process.
Figure 2:
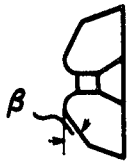
FIG. 2 is a view showing a die used in the process of this invention.

After cold working, and heating for recrystallization, the billet is extruded. If no appropriate facilities are available for the cold working of the end surface of the billet, it is advisable to use a die having a modified shape for hot extrusion in order to prevent streaks from appearing on the front end of the extruded product. A die used in a conventional process has a front surface which is tapered toward the center of the die at an angle of $\alpha$ as indicated in FIG. 1. The process of this invention, however, employs a die having a front surface tapered away from its center at an angle of $\beta$ as shown in FIG. 2.

Figure 3:
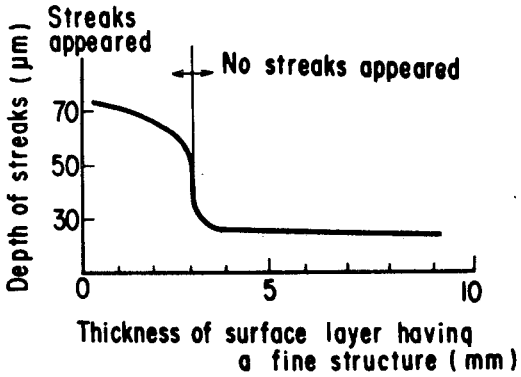
FIG. 3 is a graph showing the relationship between the thickness of a surface layer having a fine structure and the depth of streaks appearing on hot extruded products.

FIG. 3 shows the relationship between the thickness of the surface layer of a billet having a fine structure and the streaks appearing on the extruded product. It is obvious from FIG. 3 that if the billet has fine structure in a surface layer having a thickness of at least 3 mm, it is possible to obtain an extruded product having a surface which is free from streaks, and comparable to that of an extrusion from a hot rolled billet.

The invention will now be described more specifically with reference to examples thereof.

EXAMPLE 1

TABLE 1 shows principal data on the materials employed for hot extrusion. All of them were prepared from an austenitic stainless of the type known as SUS 304 in Japan.

TABLE 1

| Billet #1 | Billet #2 | Billet #3 | Billet #4 | Billet #5 |
|---|---|---|---|---|
| 180 mm dia. continuously cast billet | 180 mm dia. continuously cast billet | 180 mm dia. continuously cast billet | 180 mm dia. continuously cast billet | 180 mm dia. billet prepared from 250 × 210 mm ingot |
| Peeled by a centerless peeling machine | Not peeled | Peeled by a centerless peeling machine | Peeled by a centerless peeling machine | Peeled by a centerless peeling machine |
| Cold rolled by the centerless peeling machine at a crushing rate of 2.0 mm | Shot blasted | Cold rolled by the centerless peeling machine at a crushing rate of 1.5 mm | Not cold worked | Not cold worked |
| Cut length 600 mm | Cut length 600 mm | Cut length 600 mm | Cut length 600 mm | Cut length 600 mm |
| Cut end shot blasted | Cut end shot blasted | Cut end not cold worked | Cut end not cold worked | Cut end not cold worked |

Billets #1 to #3 represent this invention, billet #4 represents a comparative example, and billet #5 represents the prior art. The billets were heated to 1,200° C., and extruded into a product having a diameter of 50 mm and a length of 5 m at an extrusion ratio of 33, employing lubricating glass (window glass composition) having a viscosity of 2,200 ps. at 1,200° C. Billet #1 obtained a fine structure in a surface layer having a thickness of 5 to 6 mm by cold working in the centerless peeling machine, and in a surface layer having a thickness of 3 mm by shot blasting. The extruded product obtained from billet #1 showed along its entire length a surface which was comparable to that of the product from hot rolled billet #5. Billet #2 had all of its surface shot blasted, and obtained fine structure in a surface layer having a thickness of 3 mm. The resulting product showed a surface which was comparable to that of the product from billet #1. Billet #3 obtained a fine structure in a surface layer having a thickness of 3 to 4 mm by cold working in the centerless peeling machine. As its end surface had not been cold worked, streaks appeared on the extruded product in a front end portion having a length of about 1 m, while the remaining portion displayed a surface which was comparable to that of the product from billet #1.

Figure 4A:
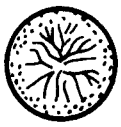
FIG. 4 is a view showing the cross sectional structure of billets heated to 1,200° C., the temperature at which billets are extruded.
Figure 4B:
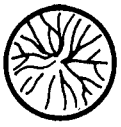
Figure 4C:
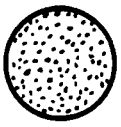

FIG. 4 shows the cross sectional structure of billets #1, #4 and #5 heated to 1,200° C. Billet #4, on which no cold working had been effected, exhibited a coarse cast structure as shown in FIG. 4*b*. Hot rolled billet #5 exhibited a fine recrystallized structure all over its cross section as shown in FIG. 4*c*. On the other hand, billet #1, which was a continuously cast and cold worked billet, exhibited a fine recrystallized structure in a surface layer having a thickness of b 3 to 6 mm, while its central portion retained a coarse as-cast structure similar to that of billet #4, as shown in FIG. 4*a*.

Figure 5A:
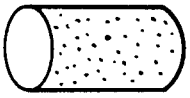
FIG. 5 is a perspective view showing the surface of products extruded from the billets shown in FIG. 4.
Figure 5B:
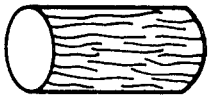
Figure 5C:
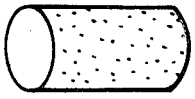

FIG. 5 shows the surfaces of the products extruded from these billets. The product extruded from billet #4 (Comparative Example) developed streaks having a maximum depth of about 100 microns as shown in FIG. 5*b*, while no streak was found on the product from hot rolled billet #5 as shown in FIG. 5*c*. The product from billet #1 was also entirely free from any streaks as shown in FIG. 5*a*, because of the fine structure in the surface layer of billet #1, despite the as-cast structure in its central portion. The same results can be obtained, irrespective of the type of steel involved, if a fine structure is formed in a surface layer of a billet having a thickness of at least 3 mm prior to extrusion.

TABLE 2 shows the surface roughness of the extruded products along their circumference and along a length of 150 mm.

TABLE 2

| Billet # | Direction | Surface Roughness (microns) |
|---|---|---|
| 1 | Circumferential | 20 to 40 |
| | Longitudinal | 20 to 40 |
| 4 | Circumferential | 80 to 100 |
| | Longitudinal | 30 to 50 |
| 5 | Circumferential | 20 to 40 |
| | Longitudinal | 20 to 40 |

The values shown in TABLE 2 are an average of the ten largest values obtained as a result of roughness measurement. In the case of Comparative Example (billet #4), the extruded product showed a surface roughness of 70 to 100 microns circumferentially, and 30 to 50 microns longitudinally. Its circumferential roughness was heavy due to the streaks, while its longitudinal roughness, which was mainly due to the lubricating glass, was relatively low. There was no difference in surface roughness between the extruded products of billets #1 and #5. The surface roughness of these products was entirely due to the glass, and the low level of their surface roughness indicated their complete freedom from streaks.

EXAMPLE 2

TABLE 3 shows principal data on the materials employed for hot extrusion.

TABLE 3

| Billet #6 | Billet #7 | Billet #8 | Billet #9 | Billet #10 |
|---|---|---|---|---|
| 180 mm dia. continuously cast billet | 180 mm dia. continuously cast billet | 180 mm dia. continuously cast billet | 180 mm dia. continuously cast billet | 180 mm dia. billet prepared from 250 × 210 mm ingot |
| Peeled by a centerless peeling machine | Peeled by a centerless peeling machine | Peeled by a centerless peeling machine | Peeled by a centerless peeling machine | Peeled by a centerless peeling machine |
| Cold rolled by the centerless peeling machine at a crushing rate of 2.0 mm | Cold rolled by the centerless peeling machine at a crushing rate of 2.0 mm | Cold rolled by the centerless peeling machine at a crushing rate of 2.0 mm | Cold rolled by the centerless peeling machine at a crushing rate of 2.0 mm | Not cold worked |
| Cut length 600 mm | Cut length 600 mm | Cut length 600 mm | Cut length 600 mm | Cut length 600 mm |
| Cut end not cold worked | Cut end not cold worked | Cut end not cold worked | Cut end not cold worked | Cut end not cold worked |
| Taper angle $\alpha$ of die was 10° | Taper angle $\alpha$ and $\beta$ were both 0° | Taper angle $\beta$ of die was 10° | Taper angle $\beta$ of die was 20° | Taper angle $\alpha$ of die was 10° |

This example is particularly featured by the use of a reversely tapered die of the type as shown in FIG. 2. Billets #6 and #7 (Comparative), and #8 and #9 (Invention) were continuously cast billets of austenitic stainless steel SUS 304, while billet #10 (Conventional) was formed from a 250×210 mm ingot of the same steel by hot rolling or cogging. The billets were extruded under the same conditions as those described in EXAMPLE 1.

Figure 6:
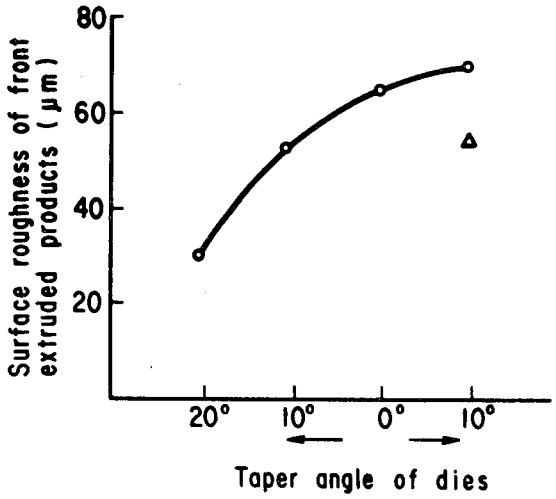
FIG. 6 is a graph showing the relationship between the taper angle of dies and the surface roughness of the front of extruded products.

FIG. 6 shows the relationship between the taper angle of the die, and the surface roughness of the front of the extruded product. In FIG. 6, the circles on the curve represent the products extruded from the continuously cast billets, while the triangle indicates the product from the hot rolled billet. The product extruded from billet #6 showed a very high degree of surface roughness due to the presence of streaks resulting from the coarse cast structure of the billet. On the other hand, the product extruded from billet #8 by employing a die having an angle $\beta$ of 10° in accordance with this invention exhibited a smooth surface which was comparable to, or even better than that of the product obtained from the hot rolled billet. The same results as those described in EXAMPLE 1 were obtained on the longitudinally middle and rear end portions of the extruded products.

As is obvious from the foregoing, the process of this invention makes it possible to produce from continuously cast stainless steel or super alloy billets extruded products having a smooth surface which is entirely free from any streak or score mark, and comparable to that of an extrusion from a hot rolled billet.

What is claimed is:

1. A process for producing a hot extruded alloy product, comprising:

cold working the surface of a continuously cast stainless steel or super alloy billet;

heating the cold worked billet to provide a fine structure in its surface layer; and hot extruding the resultant billet.

2. A process as set forth in claim 1, wherein said surface to be cold worked includes a cut end surface of said billet.

3. A process as set forth in claim 1 or 2, wherein said surface layer in which said fine structure is provided has a thickness of at least 3 mm.

4. A process as set forth in claim 1 or 2, wherein said cold working is achieved by blasting.

5. A process as set forth in claim 4, wherein said blasting also serves to remove scale from said billet surface.

6. A process as set forth in claim 1 or 2, wherein said cold working is effected by rolling at a reduction rate of 1% or less after said surface has been peeled.

7. A process as set forth in claim 1 or 2, wherein said cold working is effected by rolling by a holding roll in a centerless peeling machine simultaneously with peeling, provided said billet is circular in cross section.

8. A process as set forth in claim 1 or 2, wherein said extruding is effected by employing a reversely tapered die.

* * * * *